United States Patent [19]

Beck

[11] Patent Number: 4,631,892

[45] Date of Patent: Dec. 30, 1986

[54] COMPOSITE BEARING COLUMN

[75] Inventor: René-André Beck, Pully, Switzerland

[73] Assignee: BSA Rene Beck S.A., Pully, Switzerland

[21] Appl. No.: 713,626

[22] Filed: Mar. 19, 1985

[30] Foreign Application Priority Data

Apr. 11, 1984 [CH] Switzerland ..... 1814/84

[51] Int. Cl.[4] ..... E04C 3/34

[52] U.S. Cl. ..... 52/725; 405/239

[58] Field of Search ..... 52/295, 296, 724, 725, 52/727, 728, 722, 723, 720; 405/239, 256, 257

[56] References Cited

U.S. PATENT DOCUMENTS

| | | | |
|---|---|---|---|
| 843,683 | 2/1907 | Mannhardt | 52/727 |
| 2,992,131 | 7/1961 | Bricknell et al. | 52/727 |
| 3,352,120 | 11/1967 | Pelzer | 405/256 |
| 4,107,370 | 8/1978 | Ingraham | 428/247 |
| 4,407,106 | 10/1983 | Beck | 52/722 |

FOREIGN PATENT DOCUMENTS

| | | | |
|---|---|---|---|
| 834191 | 8/1938 | France | 405/239 |
| 307380 | 3/1929 | United Kingdom | 52/722 |

*Primary Examiner*—James L. Ridgill, Jr.
*Attorney, Agent, or Firm*—Young & Thompson

[57] ABSTRACT

A composite bearing column comprises a solid metallic core of circular or polygonal section free from reentrant recesses. The core is embedded in an intermediate layer of mortar which is compatible both with metal and with concrete. An external concrete mass surrounds the intermediate layer. Metallic bars are longitudinally distributed around the central core in that concrete mass and extend lengthwise of the column parallel to the core. The bars are welded at their opposite ends to a base plate and to a head plate. In one embodiment, mounting rings are secured to the base and head plates and extend toward each other; and a metallic wire helically surrounds the bars.

6 Claims, 4 Drawing Figures

COMPOSITE BEARING COLUMN

The present invention relates to a composite bearing column, intended to be used more particularly in metallic structures or armoured concrete constructions.

In such constructions, and for safety reasons, the metallic pillars used should be coated for example with an anti-fire concrete. As a matter of fact, if in a case of fire the metallic bearing pillars are not protected from heat, they buckle and lead to the torsion or even the cumbling of the metallic bearing structure or of the concrete components of the construction. Now, such pillars are coated with concrete after their putting in place. This necessitates the realization of a framing around these pillars for concrete casting; then, it is necessary to wait for the setting of the concrete before taking off the framing and going on with the construction. These operations are lengthy, necessitate complementary steps and consequently make the construction more expensive.

Therefore, the purpose of the present invention is to provide a composite bearing column which is resistant to heat and which does not necessitate a framing step and the casting of concrete at the construction site.

This purpose is reached by the composite bearing column, object of this invention, which is characterized by the fact that it comprises a full metallic core coated with a centrifugated concrete mass, as well as an intermediate layer of a material compatible with both the concrete and the metallic core and at least partly surrounding this latter.

The annexed drawing illustrates schematically and by way of examples two embodiments of the column according to the invention.

Figure 1:
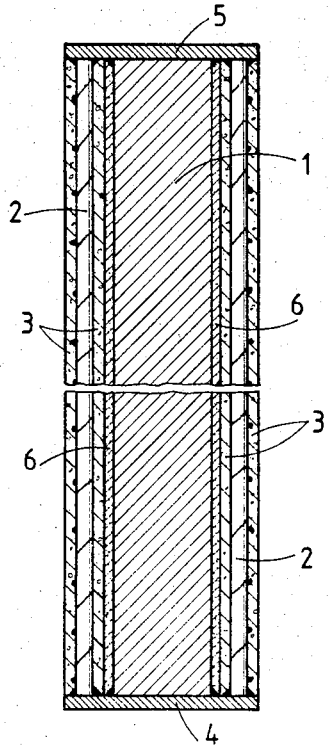
FIG. 1 is a longitudinal section view of a first embodiment.
Figure 2:
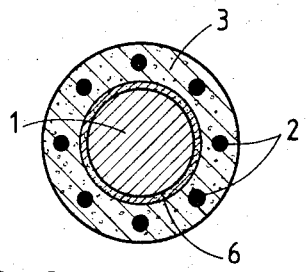
FIG. 2 is a cross-section view of the embodiment according to FIG. 1.

The first embodiment of the composite bearing column according to the invention shown in FIGS. 1 and 2 is constituted of a steel pole 1 with circular section, by a series of armouring bars 2 longitudinally distributed around the section 1 on a diameter greater than that of this latter, and by a centrifugated concrete mass 3 embedding the pole 1 and the armouring bars 2 and the section of which is also circular.

Preferably, the section 1 and the armouring bars 2 are welded at their ends on plates respectively a base plate 4 and a head plate 5, this latter being used for integrating the column itself with the construction.

The introduction in manufacture of the concrete by centrifugation is particularly important in order to obtain a column with high resistance together with a small external diameter; this step also leads to the formation between the concrete mass 3 and the steel pole 1 of an annular space 6, the size of which is determined by the quantity of concrete used. This space is filled by injection with a material compatible both with the metallic core and with the concrete, for example a mortar or a resin, this resulting in improvement in the homogeneity of the composite column thus realized and an increase in the adherence of the concrete-metallic core.

Figure 3:
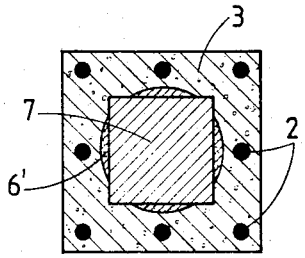
FIG. 3 is a cross-section view of a variant of the embodiment according to FIG. 1.

As shown in FIG. 3, the pole 7 of the column may have a square section, as well as the section of the column. In this case, the injected mortar or resin 6' only partly surrounds said pole 7, the space formed during the setting of the centrifugated concrete being not annular because the particular shape of said section 7. Other shapes of the metallic core and of the column itself are possible, for example rectangular, polygonal, or other.

Figure 4:
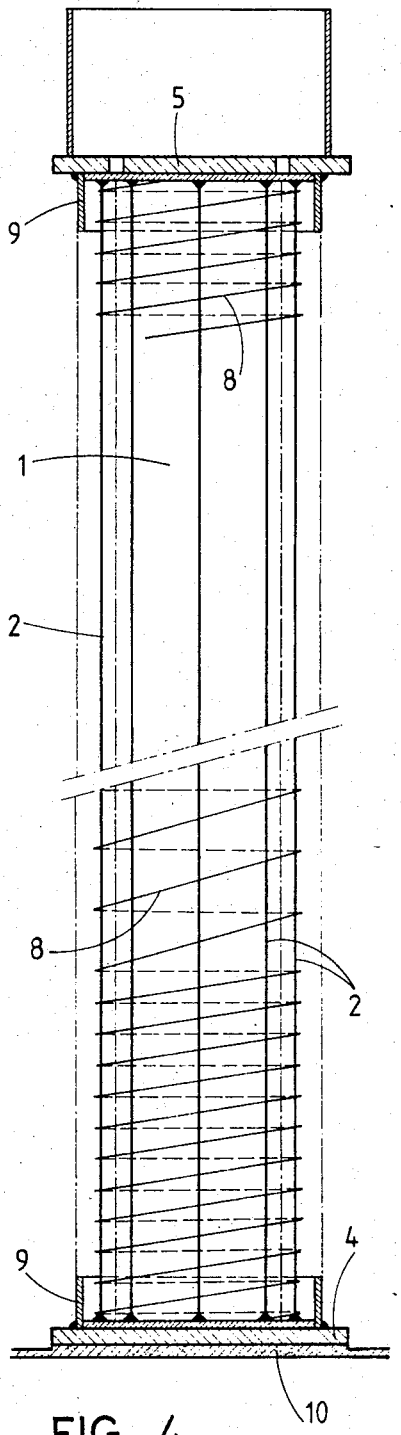
FIG. 4 is a side view, partly in longitudinal section, of a second embodiment.

With regards to the second embodiment illustrated in FIG. 4, is distinguished by the fact that the vertical armouring bars 2 are further reinforced by a hoop 8, for example formed by a metallic wire encircling said bars 2. Furthermore, a mounting ring 9 is welded on each of the respective base plate 4 and head plate 5. Finally, the base plate 4 can be fixed on the ground or other base by means of for example a layer of mortar 10.

Several types of assembles may be foreseen so as to fix a composite column to another column, composite or not, or to a metallic or armoured concrete structure.

Thus, thanks to the presence of a full metallic core, the load bearing capacity of the composite column according to the invention is greater increased, and this column can be thus advantageously used in a concrete or metallic contruction, which necessitates pillars of small sizes but with high load bearing capacity.

Furthermore, thanks to the introduction by centrifugation of the concrete around the metallic core, and to the presence of injected mortar or resin, the composite column according to the invention has a homogeneous structure and is resistant to heat for example in the case of fire.

I claim:

1. A composite bearing column, comprising a solid metallic core of circular or polygonal section free from reentrant recesses, said core being at least partly embedded in an intermediate layer of mortar compatible both with metal and with concrete, and an external concrete mass surrounding said intermediate layer.

2. A column as claimed in claim 1, in which said core is of circular cross section, said intermediate layer is of hollow cylindrical shape, and said external concrete mass is of hollow cylindrical shape, said core and intermediate layer and concrete mass being coaxial.

3. A column as claimed in claim 1, and metallic bars longitudinally distributed around the central core in said concrete mass and extending lengthwise of the column parallel to said core.

4. A column as claimed in claim 3, and a metallic wire helically surrounding said bars.

5. A column as claimed in claim 3, said core and bars being welded at their opposite ends to a base plate and to a head plate.

6. A column as claimed in claim 5, and mounting rings secured to the base and head plates and extending toward each other.

* * * * *